United States Patent [19]

Frangos

[11] Patent Number: 5,036,951

[45] Date of Patent: Aug. 6, 1991

[54] ELEVATOR-TYPE STORAGE SYSTEM

[76] Inventor: John W. Frangos, 30 Cedar St., Wenham, Mass. 01984

[21] Appl. No.: 532,924

[22] Filed: Jun. 4, 1990

[51] Int. Cl.[5] ..... B66F 7/14

[52] U.S. Cl. ..... 187/8.59; 187/8.62; 187/16; 254/92

[58] Field of Search ..... 187/8.41, 8.59, 8.62, 187/8.67, 16, 24, 25; 254/98, 89 R, 92, 7 C; 414/249, 239, 227, 228, 233

[56] References Cited

U.S. PATENT DOCUMENTS

| | | | |
|---|---|---|---|
| 1,870,069 | 8/1932 | Rugg | 187/16 |
| 2,136,750 | 11/1938 | Myers | 187/8.59 |
| 2,514,563 | 7/1950 | Todd | 187/25 X |
| 2,742,164 | 4/1956 | Francis | 187/24 X |
| 3,309,060 | 3/1967 | Villars | 187/8.41 X |
| 3,739,879 | 6/1973 | House | 187/24 |
| 4,300,659 | 11/1981 | Silverstrand | 187/8.59 |
| 4,599,034 | 7/1986 | Kennedy et al. | 254/89 R X |

FOREIGN PATENT DOCUMENTS 1-230866 9/1989 Japan .

*Primary Examiner*—Robert P. Olszewski
*Assistant Examiner*—Dean A. Reichard
*Attorney, Agent, or Firm*—Pearson & Pearson

[57] ABSTRACT

An elevator-type storage structure for storing objects received at an access level at a vertically spaced storage level. The structure includes a supporting frame. A vertical displacement mechanism including a vertically traveling nut assembly supports a platform at one end thereof as a cantilever. The displacement mechanism displaces the platform vertically between access and storage levels. Stabilizing elements interconnect the platform at the other end thereof and cooperative elements of the structure to stabilize the platform in a horizontal plane.

17 Claims, 8 Drawing Sheets

ELEVATOR-TYPE STORAGE SYSTEM

BACKGROUND OF THE INVENTION

1. Field of the Invention

This invention generally relates to storage systems for providing vertically oriented, easily accessible storage compartments for large volumetric storage and more particularly to such systems particularly adapted for storing automobiles.

2. Description of Related Art

There are many different storage systems useful for storing or warehousing large items such as automobiles. This invention is particularly adapted to those systems that provide segregated storage with ready access to any individual location and that minimize the land or floor space requirements for multiple compartments.

Parking garages are examples of such systems. In a typical parking garage an individual or attendant parks a car at a specific location. In such structures the floors must have at least an eight-foot clearance to provide a clear walking passage. Such garages often have minimal security so any individual can walk around on the floors and reach separate automobiles.

Another parking garage scheme uses a building structure with a number of storage compartments arranged in a vertical matrix that are one or more automobile lengths deep. An elevator structure receives automobiles on a main floor and elevates and positions them adjacent a particular compartment. These systems permit denser storage than is available in the first type of parking garage. However, they require personnel to run the elevators. Moreover, at certain hours long retrieval times may be encountered because all cars must be moved through a relatively small number (for example, 1 or 2) of elevators.

Both types of structures are expensive to construct, but they are justified in urban settings. Now smaller communities have implemented various zoning requirements they seek to increase the number of parking places available in commercial or clustered residential developments. The conventional approach to merely making a larger parking lot is not as desirable because land may not be available. Moreover, large parking areas can detract from the overall aesthetics of the area replacing vegetation with gravel, macadam or other paving materials. Thus there is a need for a multiple-story parking garage that is simple to operate, provides reasonable security and is reliable. Such systems could be incorporated in or adjacent to individual homes or small business buildings that have a requirement to improve parking densities. The following references disclose such structures:

U.S. Pat. No. 2,655,223 (1953) Villars
U.S. Pat. No. 3,294,260 (1966) Frangos
U.S. Pat. No. 4,416,578 (1983) Behncke
IT 579,327 (1958) Tamini
UK 1,157,248 (1969) Lipkau The Villars patent discloses a vehicle lifting device that comprises parallel longitudinally extending rails carried on cross beams that mate with a connecting structure in each of four upstanding posts. The elevating structure comprises a motor and transmission system that connects to a ball screw mechanism at each of the posts. Energizing the motor either elevates or lowers the frame structure.

A parking garage in accordance with the Frangos patent comprises a building structure having one or more horizontally extending passageways with parking stalls located above and below the passageway. A dolly, having an open center portion rides along the passageway with a platen for carrying a vehicle. Mechanisms associated with the dolly raise the vehicle and platen into a parking stall located above the passage or lower the platen into a parking stall disposed below the passage.

The Behncke patent discloses a roof-covered multi-storage elevator-type garage having two vertically displaceable structures with platforms that are vertically displaced by a distance that accommodates an automobile. An elevating structure moves the structure with both platforms as a unit to a reference or access level. A garage roof attaches to the upper platform and covers the structure. The roof has its own elevating mechanism so the vertical space to the roof is reduced when the upper platform moves above the access level.

As disclosed in the Tamini patent, a compartmental structure carries a plurality of automobiles. The structure comprises vertically aligned, horizontal platforms that support multiple automobiles. The entire structure with all vehicles elevates or lowers into a supporting cavity structure thereby to position each automobile with respect to an access level.

The Lipkau patent discloses a group of vertical posts each containing a ball-screw mechanism. Each post engages a corner of a platform. Certain intermediate columns contain two ball-screw assemblies for engaging adjacent platforms. A single motor drive couples selectively to the individual ball-screw mechanisms to elevate or lower each platform independently.

Each of these structures is adapted for providing storage of large volumetric articles such as automobiles in discreet compartments or locations. However, each of these systems seems more costly to install then is justified in residential and small business environments. Structures and operating mechanisms such as shown in the Behncke and Tamini patents must be sufficiently strong to move multiple automobiles. Moreover, these structures may require an operator to control various operations. Thus these types of parking structures have not found wide spread acceptance particularly in residential and limited commercial applications.

SUMMARY

Therefore it is an object of this invention to provide a structure adapted for providing compartmentalized storage with an elevator-type structure.

Another object of this invention is to provide an elevator-type storage structure that is reliable to use and provides a secure environment.

Yet another object of this invention is to provide an elevator-type structure that is easy to operate and adapted for automated systems.

Still another object of this invention is to provide an elevator-type structure that comprises a plurality of standard construction modules.

Still another object of this invention is to provide an elevator-type storage structure adapted for parking automobiles that can be constructed for a minimal cost.

Still another object of this invention is to provide an elevator-type storage structure for parking automobiles adapted for automatic operation.

In accordance with this invention an elevator-type storage structure receives an object, such as an automobile, at first or access level and stores the object at a second or storage level. The storage structure comprises a supporting frame and platform means for supporting an object. The platform has a first end portion and an oppositely disposed second end portion extending along a central horizontal axis. Elevating means mounted to the supporting frame means engage the second end portion on the central horizontal axis and move the platform vertically as a cantilever. First and second stabilizing means connected to the first end portion of the platform and spaced from the horizontal axis stabilize the platform in a horizontal plane.

In accordance with another aspect of this invention a platform, elevating means and stabilizing elements constitute a storage module. Multiple modules can be mounted vertically with a door module therebetween for closing openings and separating the modules.

BRIEF DESCRIPTION OF THE DRAWINGS

This invention is pointed out with particularity in the appended claims. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
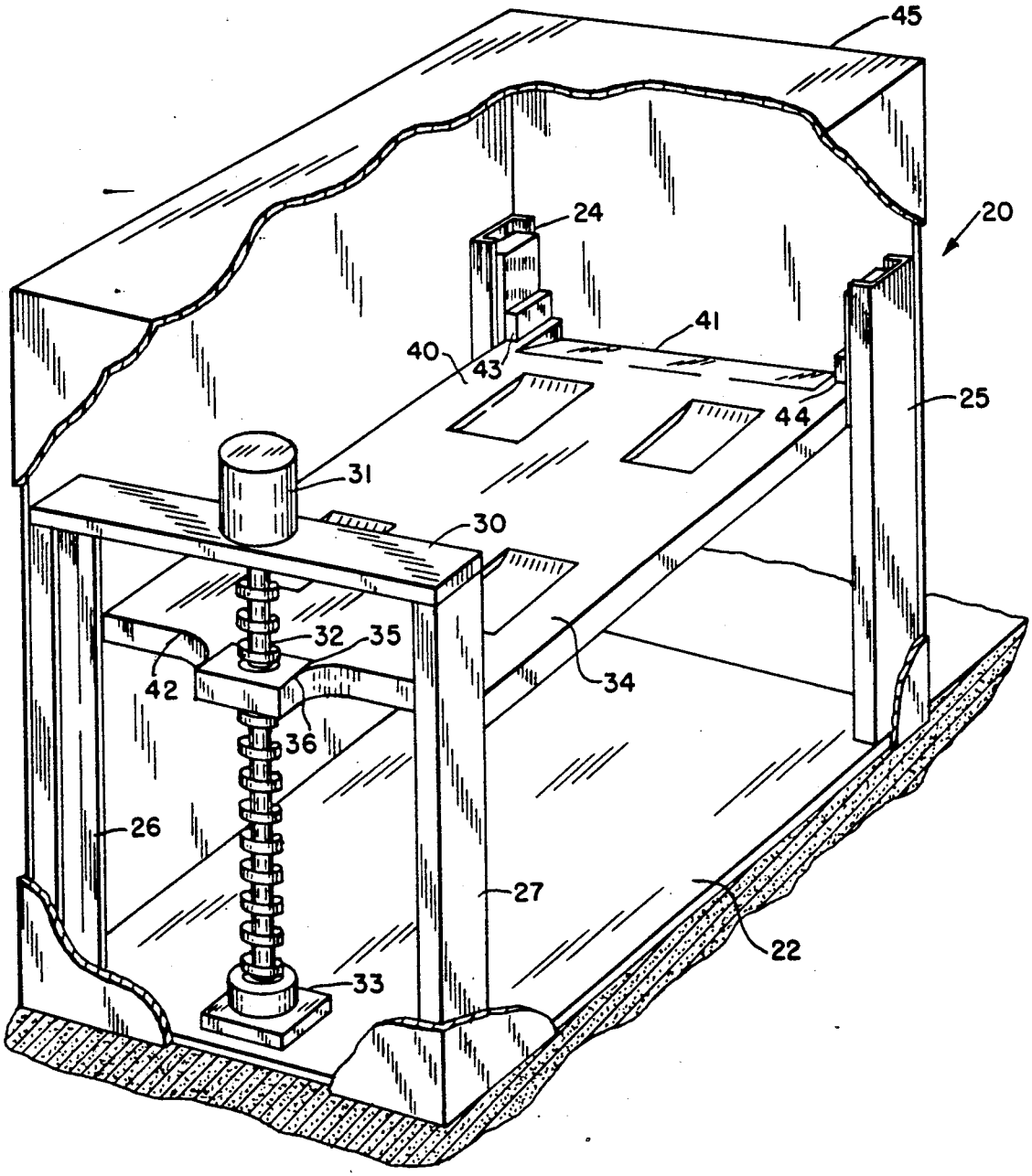
FIG. 1 is a perspective view of a storage module constructed in accordance with this invention for elevating an item above ground.

FIG. 1 discloses, in a perspective view, a garage module 20 for receiving an object, such as an automobile, at an access level, in FIG. 1 the ground 21, and for elevating the item vertically to a storage level. FIG. 1 is a schematic representation of such a garage system; persons of ordinary skill in the art can adapt this to a particular implementation. As becomes apparent later, it is anticipated that this invention will be implemented in a modular form. Therefore, the various embodiments disclosed in the description and figures present modular construction. Custom, or non-modular construction can also be used to implement this invention.

More specifically, a storage facility such as the garage module 20, includes a floor member 22 that may be a concrete slab, a metal panel integral with the module 20, or a separate element. The garage module 20 also includes four upstanding corner posts 24, 25, 26, and 27 at each corner of the floor 22. The length of an item, such as an automobile, to be stored length determines the spacing between the two corner posts 24 and 26 and the two corner posts 25 and 27. The width of the item to be stored, such as the width of an automobile, determines the width between the two corner posts 24 and 25 and the two corner posts 26 and 27. Thus, the corner posts 24, 25, 26 and 27 define the horizontal extent of the storage level or area.

Corner posts 26 and 27 carry a cross beam 30 that is vertically spaced from the floor 22 by a dimension dependent upon differences between the access and storage levels. The cross beam 30 carries a motor drive 31 that rotates a ball-screw output shaft 32 and thrust bearing 33 mounted at the floor 22. Typically the ball-screw shaft 32 also pivots in a thrust bearing at the cross beam 30 that is formed within the cross beam 30 or integrally with the motor drive 31.

An elongated platform 34 extends along a central horizontal axis 35 that intersects a traveling nut assembly 36 connected to the platform 34. The platform 34, lies within the storage level or area that the corner posts 24, 25, 26 and 27 define and may include a structure with a solid surface as shown in FIG. 1, a grid surface to conserve weight or a combination of a grid and lightweight solid surface. More specifically the platform 34 has a generally rectangular area 40 with a first end portion 41 transverse to the axis 35 and a second end portion 42 spaced from the first end portion 41 and proximate the shaft 32. The second end portion 42 connects to the traveling nut assembly 36 at the central axis 35. Corner blocks 43 and 44 at the first end portion 41 contain stabilizing elements that coact with vertical channels formed in the upstanding corner posts 24 and 25 for stabilizing the platform 34 in a horizontal plane.

As will be apparent, when the motor drive 31 turns the shaft 32 clockwise or counterclockwise, the traveling nut 36 elevates or lowers the platform 34 depending upon the orientation of the threads on the shaft 32. The corner posts 24 and 25 and corner blocks 43 and 44 interact to prevent any tendency of the platform 34 to torque about the shaft 32 thereby stabilizing the platform 34 in a horizontal plane. Moreover, as the platform 34 carries a maximum load corresponding to one particular item, such as a single automobile, the cantilevered structure of the platform extending from the travelling nut 36 can be implemented. A cantilevered support would not be economically possible if the shaft 32 were required to lift multiple objects. Further the use of a single ball-screw shaft and traveling nut eliminates many of the synchronization problems that can occur in prior art devices that incorporate multiple ball-screw arrangements.

In operation, a control circuit, not shown, energizes the motor drive 31 and lowers the platform 34 to the ground or access level. An individual drives an automobile onto the platform 34 or loads an item to be stored on the platform 34. Then the control system energizes the motor drive 31 in an opposite direction to elevate the platform 34 by some predetermined amount. In a garage application, this platform would displace about 7 to 8 feet vertically.

As shown in FIG. 1, this structure can be adapted for maximum security. An optional housing 45 circumscribes the module 20 in FIG. 1 and encloses the space above a plane through the cross beam 30. While the platform 34 normally will be elevated to a height above the ground plate 22 so an individual can comfortably walk on the ground plate 22 when the platform 34 is raised, the height of the housing 45 above the platform 34 in its raised position can be significantly less. Typically the height above the raised platform 34 corresponds to the maximum height of an automobile that would be stored in such a housing. Thus the above-ground dimension could be reduced by nearly 15% over a standard two-story structure. In many situations a more attractive and aesthetic structure that is less expensive to construct results. Although FIG. 1 discloses box structure for the housing 45, it will be apparent that alternative roof structures can be utilized as desired.

As previously indicated, FIG. 1 depicts this structure in a schematic form. An actual structure will include gussets, cross braces and related items required for structural integrity. However, such items are details that are not necessary for an understanding of the invention and their incorporation into a specific structure is well within the ability of persons of ordinary skill in the art.

Figure 2:
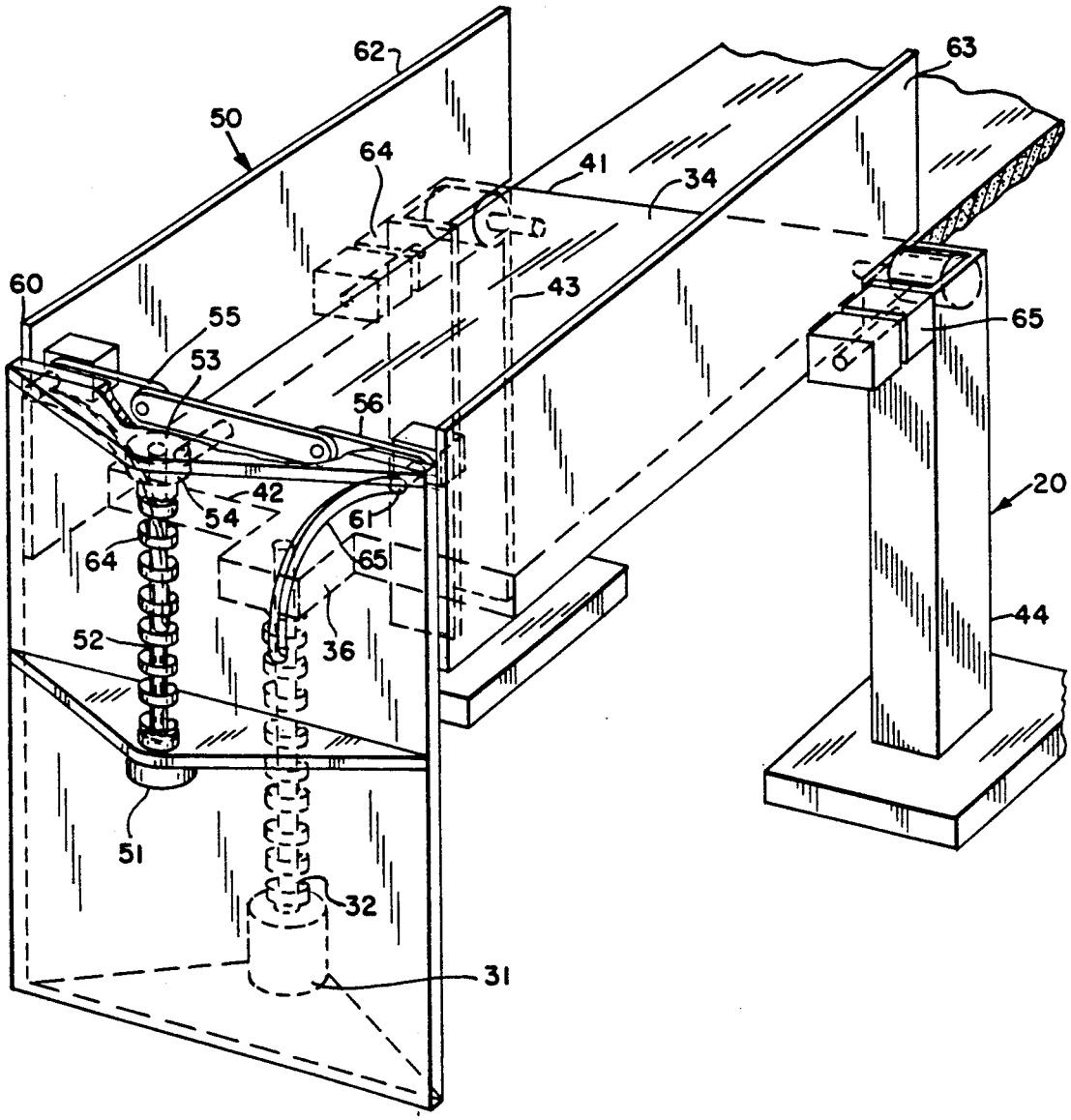
FIG. 2 is a perspective view of a portion of a multiple module structure including a door module for closing a subterranean module.

FIG. 2 discloses a module 20 that is inverted for a subterranean installation. A door module 50 overlies the top portion of the module 20 and closes the opening when the platform 34 is lowered. The module 20 in FIG. 2 includes a motor drive 31 and related apparatus for driving the shaft 32 and a traveling nut 36 thereby to elevate and lower at the platform 34. Access is provided when the platform 34 is at ground level, an item to be stored being loaded from the first end section 41. The traveling nut 36 is located at the second end section 42. Corner blocks 43 and 44 provide the stabilizing function.

The door module 50 closes the opening that would otherwise exist when the platform 34 lowers below ground level. A number of different implementations are possible. In this particular application, a separate motor drive 51 and ball screw shaft 52 rotate in an end bearing 53. A traveling nut 54 engages arms 55 and 56 attached as cranks to a door mechanism. As the arms 55 and 56 rotate about pivots 60 and 61 respectively, they open or close doors 62 and 63 about pivots 64 and 65 respectively. Other linkages might interconnect the door operating mechanism with the platform 34. The door structures could vary from simple pivoted doors to doors that elevate into a vertical position and retract into the structure as the platform 34 elevates. In any case, the door module 50 safely closes the opening that results when the platform 34 lowers. The doors 62 and 63 should have sufficient strength to hold an automobile or other structure. It will also be apparent that this door structure can be also formed as a module to be merely connected to the top of or in the vicinity of the upper portion of the module 20 shown in FIG. 2.

FIGS. 3 through 6 disclose a warehousing or parking garage structure for storing items above and below a ground or access level. A first storage module 70, that is similar to the module 20 shown in FIG. 1, includes a motor drive 71 and a ball-screw shaft 72. Corner posts 73 and 74 interact with stabilizing units. One such unit in FIG. 3 includes an axle 75 and roller 76 that ride in a channel 77. More specifically, each corner block on the platform 78 carries an axle 75 and roller 76. The vertical channel 77 in the corner post 73 shown in FIG. 3, receives the roller 76 thereby to allow platform 78 to elevate and lower while the roller moves in the channel 77.

A second module 80 includes a motor drive 81, a ball-screw shaft 82, and corner posts 83 and 84 displaced from the shaft 82. The corner post 83 includes an axle 85, roller 86 and channel 87. A platform 88 associated with the second module 80 carries the axle 85 and roller 86, so the roller 86 can move freely in the channel 87.

Figure 6:
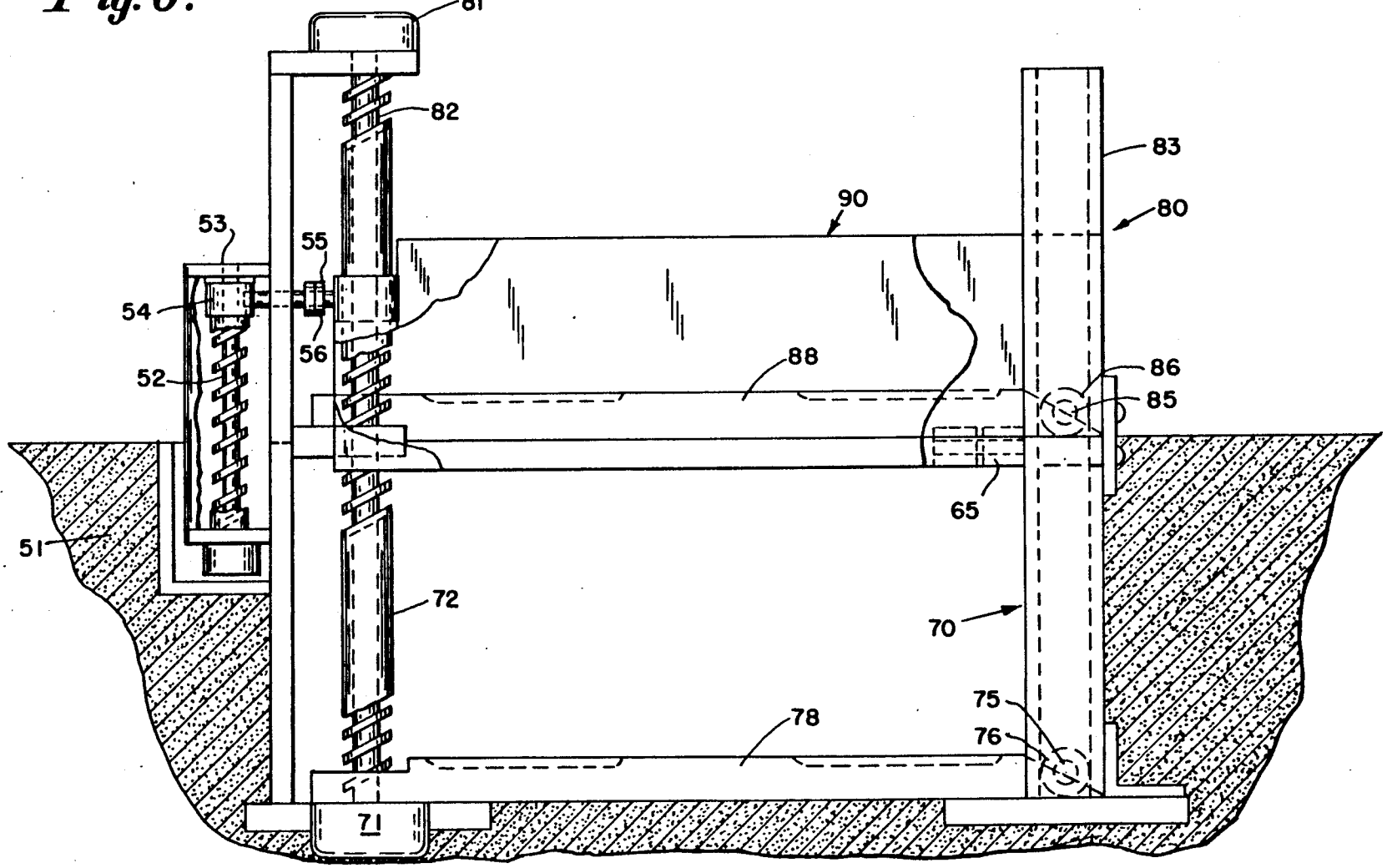
FIG. 6 depicts the structure of FIG. 2 in an empty state.

Door module 90, shown in schematic form in FIG. 6, is intermediate the modules 70 and 80. As previously indicated, the door module 90 closes the opening that exists when the platform 78 lowers.

Figure 3:
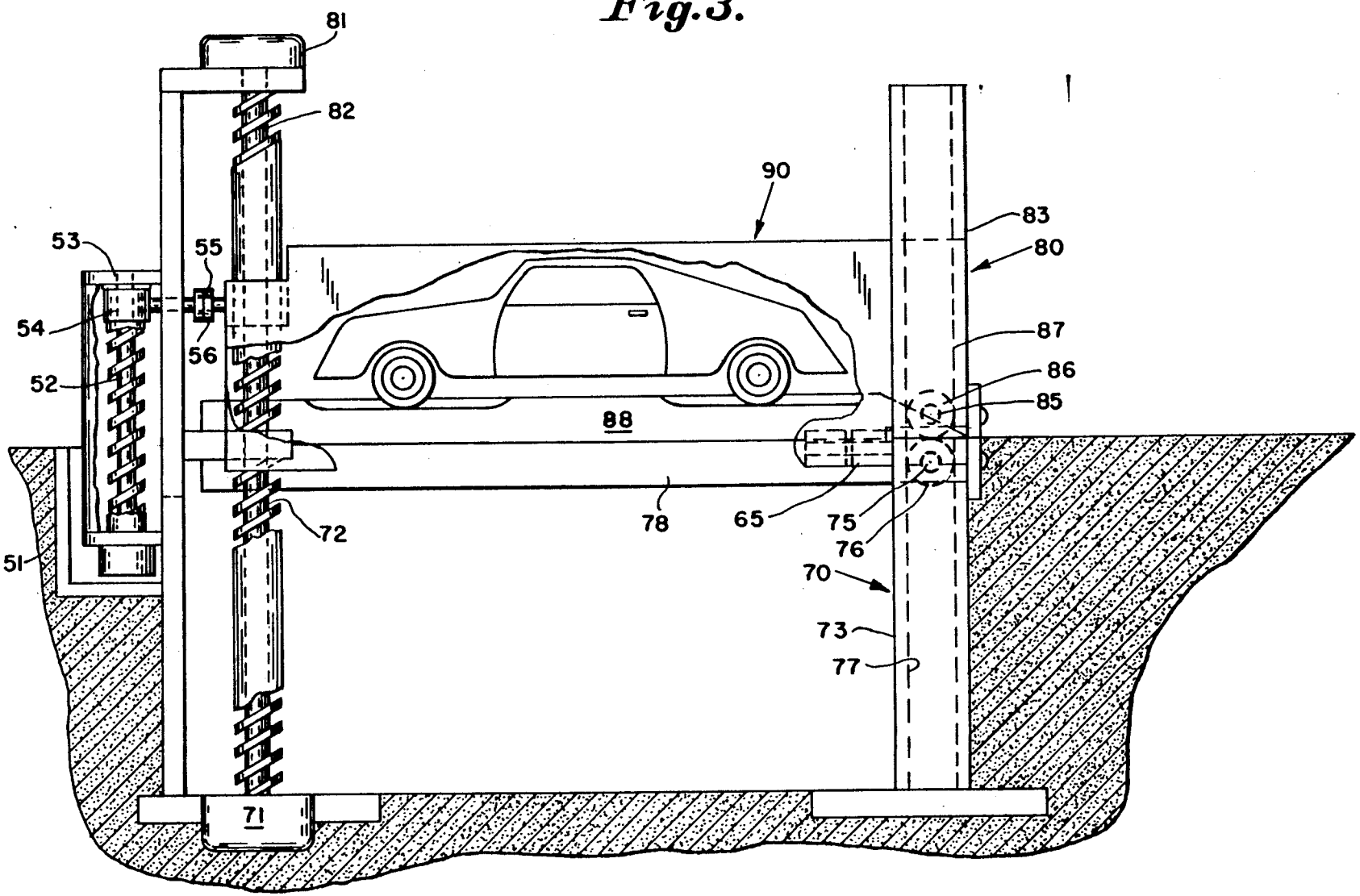
FIG. 3 is a side view of a structure such as shown in FIG. 2.
Figure 4:
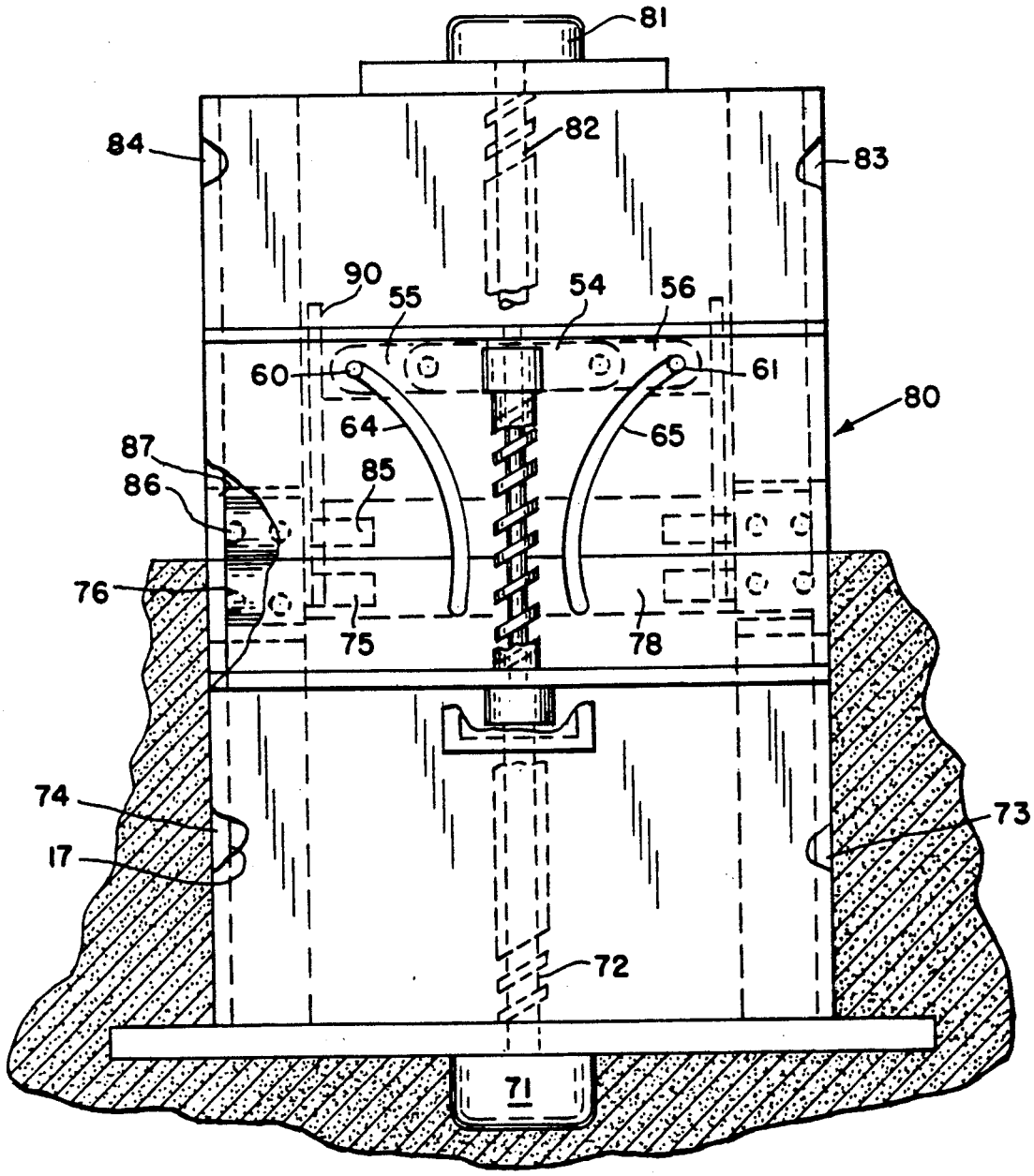
FIG. 4 is an end view of the structure shown in FIG. 2.
Figure 5:
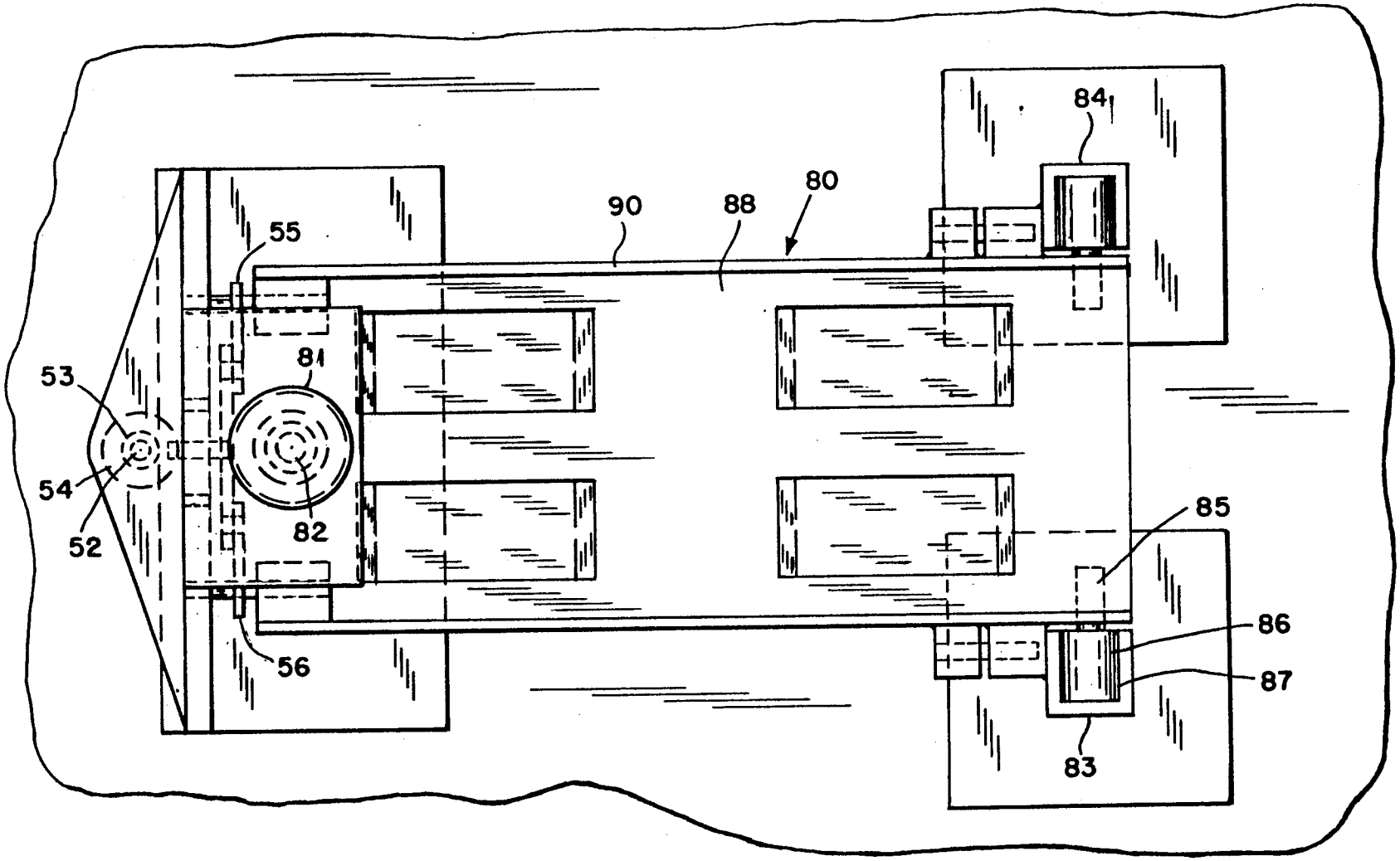
FIG. 5 is a top view of the structure shown in FIG. 2.
Figure 7:
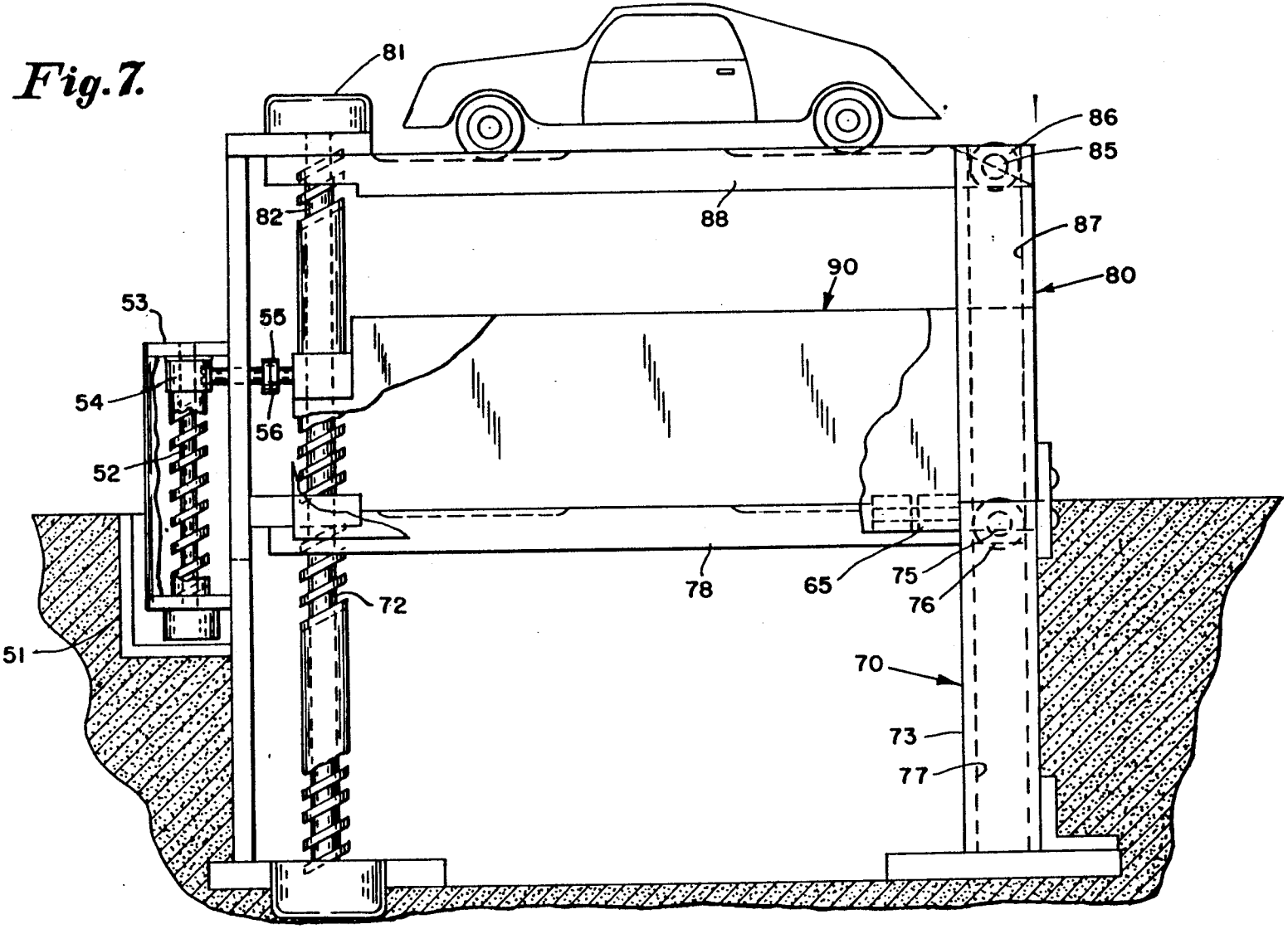
FIG. 7 is a side view of FIG. 2 depicting the structure with a single automobile in storage.

FIG. 6 discloses the basic elements of a parking garage or similar structure constructed in accordance with this invention as shown in FIGS. 3 through 5 with the platforms 78 and 88 in their lower-most positions. With this orientation, an individual can drive an automobile or load an item onto the platform 88 from ground level. In a parking garage arrangement, the individual could then lock the car, exit the area to a control panel, deposit an appropriate amount of money or utilize an individual key, energize a control system to energize the motor drive 81 thereby raising the platform 88 to its upper-most position as shown in FIG. 7. Other control circuitry could then energize the door module 90 to close the doors and the open pit produced with the platform 78 in its lower position.

Alternatively the control system could also energize the motor drive 71 and rotate the shaft 72 independently of the shaft 82 thereby to elevate the platform 78 to ground level. A number of other possibilities exist. As shown in FIG. 7, however, an automobile 100 is stored on the platform 88 and the platform 78 is positioned to receive another automobile.

Figure 8:
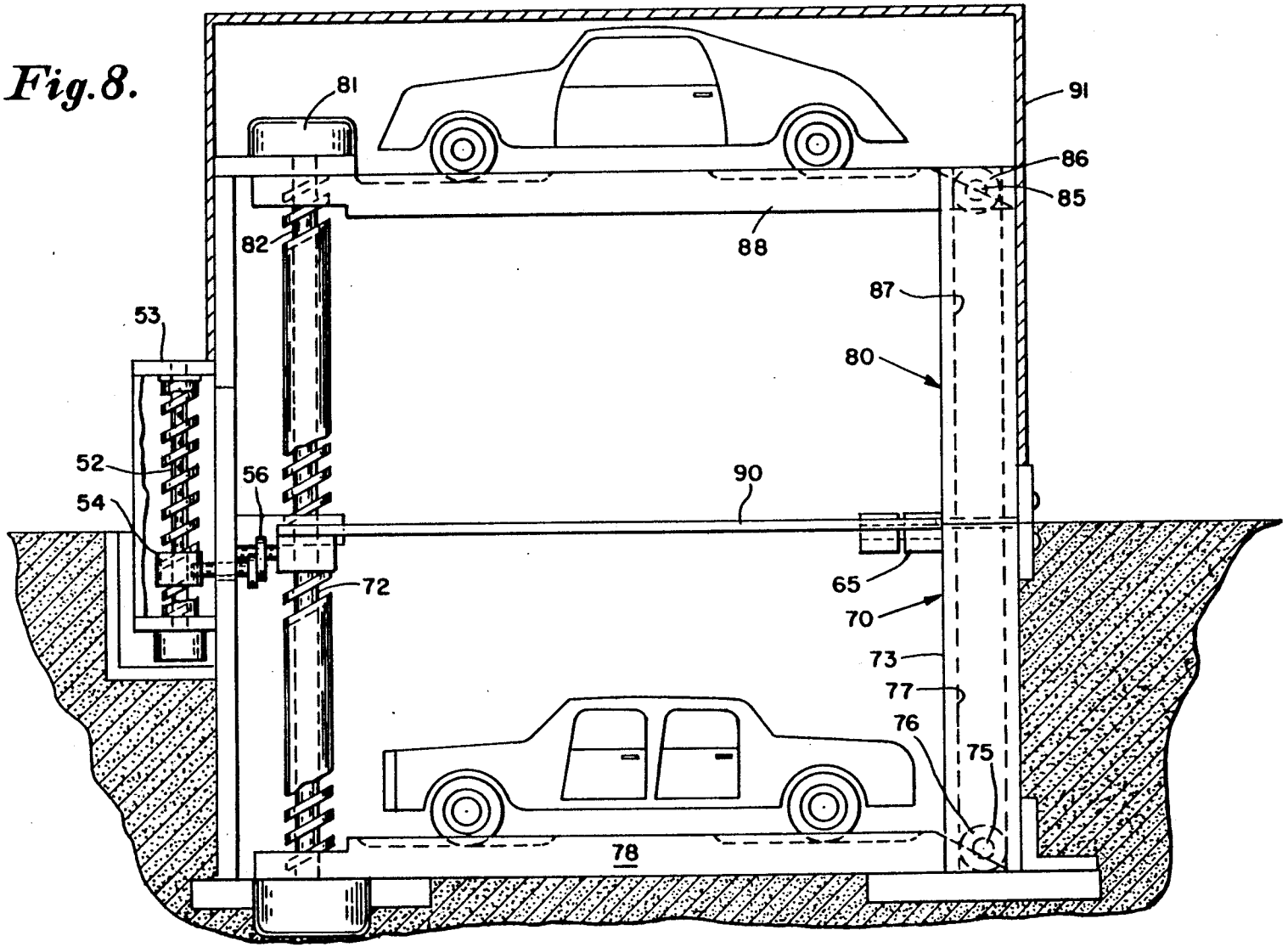
FIG. 8 depicts the structure in FIG. 2 with two automobiles in storage.

FIG. 8 discloses the structure after the motor drive 71 lowers an automobile 101 parked on the platform 78 to a bottom position In this figure dashed lines 90 represent the door module with closed doors to indicate the general location of such a structure. As apparent from FIGS. 6 through 8, this structure stores two automobiles. An individual can access either automobile independently of the other. There is no need to shuffle the cars in order to obtain either automobile. Finally, if the door structure 90 is sufficiently strong, in a commercial environment the closed doors could constitute a platform for temporary or short-term parking.

Maximum security can be obtained by installing a structure that covers the portion of the module 80 above ground. Such a structure is represented by cross sectioned structure 91. As will be apparent from the scale of FIG. 8, the height between the closed doors 90 and the platform 88 in the raised position is greater than the height between the top of the structure 91 and the platform 88 in the raised position, as this latter height need only be sufficient to provide vertical clearance for an automobile.

Therefore in accordance with the various objects of this invention, a structure as shown in FIGS. 1 through 8 provides secure storage for various items including automobiles. Access can be readily controlled by various known locking and automated access systems. As each motor drive and related structure only handles a single automobile, the overall structure is easier and less expensive to construct than systems where the lifting structure must support more than a single automobile. This further facilitates and simplifies various controls, including interlock systems, required for maximum flexibility.

Further the structure shown in FIGS. 6 through 8 provides a means for storing three automobiles in a space that corresponds to a single space in a parking lot. Parking density can be therefore greatly increased. Such a structure is also adapted to automated facilities as might be used in a business parking lot. In such arrangements an individual might drive a car onto the platform 78 or 88 that was as the access level. The individual could then lock the automobile and return to a control box to deposit the appropriate fee and retrieve an encoded card specifying the location of the automobile. The control system then would raise or lower the corresponding platform to a storage position. When the individual returned, the control system would read the card, decode the position and lower the upper platform 88 or raise the lower platform 78 to the access position thereby to allow the individual to retrieve the automobile. This all can be done without attendants and without the need to shuffle automobiles.

It will also be apparent that while a ball screw shaft and traveling nut arrangement are preferred for elevating the platforms, other mechanisms including hydraulic lift mechanisms could also be used while attaining at least some or all of the objectives and advantages of this invention.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An elevator-type structure for receiving an object at an access level and storing the object at a vertically displaced storage level, said structure comprising:

A. supporting frame means for supporting the structure including upstanding post means for defining the horizontal extent of the storage level in a horizontal plane, B. platform means adapted for supporting the object and characterized by having first and second oppositely disposed end portions, a central horizontal axis extending through said first and second end portions, C. displacement means mounted to first ones of said post means and engaged with said platform means at said second end thereof only at the central horizontal axis for constituting sole means for displacing said platform vertically, said platform being cantilevered relative to said supporting frame means, and D. stabilizing means for engaging the others of said post means and positions at said first end portion of said platform means spaced from the central horizontal axis for stabilizing said platform in a horizontal plane.

2. An elevator-type storage structure as recited in claim 1 wherein said displacement means comprises motor drive means, a vertically oriented, threaded output shaft connected to said motor drive means and traveling nut means connected to said platform and engaging said threaded output shaft whereby said traveling nut means displaces said platform means vertically when said output shaft rotates.

3. An elevator-type storage structure as recited in claim 2 wherein said stabilizing means comprises vertical channel means mounted to said supporting frame means and roller means mounted to the corners of said platform means at said first end portion for engaging said channels.

4. An elevator-type storage structure for receiving objects at an access level and storing one object at an elevated level and another object at a lower level, said structure comprising:

A. supporting frame means;

B. first and second storage module means, each said storage module means including:

i. platform means adapted for supporting an object and characterized by having a first end portion and an oppositely disposed second end portion, a central horizontal axis extending through said first and second end portions, ii. displacement means mounted to said supporting frame means and engaged with said platform means at said second ends at the central horizontal axis for displacing said platform vertically, said platform being cantilevered relative to said supporting frame means, and iii. stabilizing means interconnecting said first end portion of said platform means at positions spaced from the central horizontal axis and said supporting frame means for stabilizing said platform means in a horizontal plane, and C. door module means intermediate said first and second modules for forming a horizontal support surface between said modules when said platform means are displaced from their respective access levels.

5. An elevator-type storage structure as recited in claim 4 wherein each of said displacement means comprises motor drive means, a vertical threaded output shaft connected to said motor drive means and traveling nut means connected to said platform means and engaging said threaded output shaft whereby said traveling nut means displaces said platform means vertically when said output shaft rotates.

6. An elevator-type storage structure as recited in claim 5 wherein displacement means constitutes the sole means for displacing said platform means vertically.

7. An elevator-type storage structure as recited in claim 5 wherein said stabilizing means comprises vertical channels mounted in said supporting frame means and roller means mounted to the corners of said platform means at said first end portion for engaging said channels.

8. An elevator-type storage structure as recited in claim 5 wherein said door module means comprises first and second door panel means, means for guiding said door panel means between open and closed positions, and drive means for moving said door panel means between said open and closed positions.

9. An elevator-type parking garage for receiving an automobile at an access level and storing the automobile at a storage level that is displaced vertically with respect to said access level, said parking garage comprising:

A. a stabilized frame structure means for supporting the structure including upstanding post means for defining the horizontal extent of the storage level, B. platform means adapted for supporting the automobile and characterized by having first and second oppositely disposed end portions, a central horizontal axis extending through said first and second end portions, C. displacement means mounted to first ones of said post means and engaged with said platform means at said second end thereof only at the central horizontal axis for constituting sole means for displacing said platform means vertically, said platform means being cantilevered relative to said supporting frame means, and D. stabilizing means for engaging the others of said post means and positions at said first end portion of said platform means spaced from the central horizontal axis for stabilizing said platform means in a horizontal plane.

10. An elevator-type parking garage as recited in claim 9 wherein said displacement means comprises motor drive means, a vertically oriented, threaded output shaft connected to said motor drive means and traveling nut means connected to said platform means and said threaded output shaft whereby said traveling nut means displaces said platform means vertically when said output shaft rotates.

11. An elevator-type parking garage as recited in claim 10 wherein said stabilizing means comprises vertical channels mounted to said supporting frame structure means and means mounted to the corners of said platform means at said first end portion for engaging said channels.

12. An elevator-type parking garage as recited in claim 10 wherein said stabilized structure means additionally includes roof means for covering said parking garage.

13. An elevator-type parking garage for storing first and second automobiles received at a first access level at first and second storage levels respectively, said first storage level being elevated with respect to said access level and said second storage level being below said access level, said parking garage comprising:

A. foundation means including a subterranean cavity disposed in the ground,

B. first and second storage module means, each said storage module means including:

i. platform means adapted for supporting an automobile and characterized by having a first end portion and an oppositely disposed second end portion, a central horizontal axis extending through said first and second end portions, ii. displacement means mounted to said supporting frame means and engaged with said platform means at said second ends at the central horizontal axis for displacing said platform means vertically, said platform means being cantilevered relative to said foundation means, and iii. stabilizing means interconnecting foundation with said first end portion of said platform means at positions spaced from the central horizontal axis and said foundation means for stabilizing said platform means in a horizontal plane, and C. door module means intermediate said first and second storage module means for forming a horizontal support surface between said storage module means when said platform means are displaced from their respective access levels.

14. An elevator-type parking garage as recited in claim 13 wherein each of said displacement means comprises motor drive means, a vertical threaded output shaft connected to said motor drive means and traveling nut means connected to said platform means for engaging said threaded output shaft means whereby said traveling nut means displaces said platform means vertically when said output shaft rotates.

15. An elevator-type parking garage as recited in claim 14 wherein said stabilizing means comprises vertical channels mounted to said supporting frame means and means mounted at said first end portion for engaging said channels.

16. An elevator-type parking garage as recited in claim 14 wherein said stabilized structure means additionally includes roof means for covering said structure.

17. An elevator-type parking garage as recited in claim 14 wherein displacement means constitutes the sole means for displacing said platform means vertically.

* * * * *